US011016405B2

(12) United States Patent
Hong

(10) Patent No.: US 11,016,405 B2
(45) Date of Patent: May 25, 2021

(54) ELECTROPHOTOGRAPH TONER

(71) Applicant: HEWLETT-PACKARD DEVELOPMENT COMPANY, L.P., Spring, TX (US)

(72) Inventor: Jin-mo Hong, Suwon-si (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/844,543

(22) Filed: Apr. 9, 2020

(65) Prior Publication Data

US 2020/0257214 A1 Aug. 13, 2020

Related U.S. Application Data

(63) Continuation of application No. 16/283,281, filed on Feb. 22, 2019, now Pat. No. 10,656,544, which is a continuation of application No. PCT/KR2016/013674, filed on Nov. 25, 2016.

(30) Foreign Application Priority Data

Sep. 13, 2016 (KR) ..... 10-2016-0118215

(51) Int. Cl.

| | |
|---|---|
| ***G03G 9/09*** | (2006.01) |
| ***G03G 9/087*** | (2006.01) |
| ***G03G 9/10*** | (2006.01) |
| ***G03G 9/097*** | (2006.01) |

(52) U.S. Cl.
CPC ..... *G03G 9/08708* (2013.01); *G03G 9/087* (2013.01); *G03G 9/08755* (2013.01); *G03G 9/09* (2013.01); *G03G 9/09708* (2013.01); *G03G 9/10* (2013.01)

(58) Field of Classification Search
CPC ..... G03G 9/09; G03G 9/0902; G03G 9/09385
See application file for complete search history.

(56) References Cited

U.S. PATENT DOCUMENTS

| | | | | |
|---|---|---|---|---|
| 10,656,544 | B2 * | 5/2020 | Hong | G03G 9/09725 |
| 2009/0045360 | A1 * | 2/2009 | Wosnick | B41M 3/144 250/586 |
| 2010/0196817 | A1 * | 8/2010 | Sasaki | G03G 9/0819 430/109.4 |
| 2014/0028011 | A1 * | 1/2014 | Yamauchi | B42D 25/387 283/74 |

FOREIGN PATENT DOCUMENTS

| | | |
|---|---|---|
| JP | 2004295101 | 10/2004 |
| JP | 2012121170 | 6/2012 |
| JP | 5369861 | 12/2013 |
| KR | 10-2008-0044084 | 5/2008 |
| KR | 10-1500829 | 3/2015 |

* cited by examiner

*Primary Examiner* — Peter L Vajda
(74) *Attorney, Agent, or Firm* — Staas & Halsey LLP

(57) ABSTRACT

A toner for electrophotography includes a toner particle including a binder resin, a colorant, and a releasing agent, and an additive material including a quantum dot-inorganic particle composite. The additive material is attached to an external surface of the toner particle. The quantum dot-inorganic particle composite includes quantum dot particles and inorganic particles present between the quantum dot particles.

18 Claims, No Drawings

ELECTROPHOTOGRAPH TONER

CROSS-REFERENCE TO RELATED APPLICATIONS

This application is a continuation application of U.S. patent application Ser. No. 16/283,281, filed on Feb. 22, 2019, which is a continuation application of PCT International Patent Application No. PCT/KR2016/013674, filed on Nov. 25, 2016, which claims priority from Korean Patent Application No. 10-2016-0118215, filed on Sep. 13, 2016 in the Korean Intellectual Property Office. The disclosures of the U.S. patent application Ser. No. 16/283,281, the PCT international Patent Application No. PCT/KR2016/013674 and the Korean Patent Application No. 10-2016-0118215 are incorporated herein by reference.

BACKGROUND

A toner for forming an image by using an electrophotography method is to have a high design freedom to satisfy requirements such as high quality, reliability, and productivity at the same time. The toner is also to have small-sized particles, a narrow particle size distribution, and a wide color gamut to obtain a high-quality image. In addition, there is a demand for a toner having a lower fixing temperature to reduce energy consumption and an emitted amount of carbon dioxide ($CO_2$). Accordingly, recently, there has been an increasing demand for a polymerized toner being able to easily satisfy such requirements.

DETAILED DESCRIPTION

However, most unauthentic toners or refill toners are pulverized toners. It is very difficult to prepare the pulverized toner to have a small particle size. Also, it is very difficult to control a particle shape of the pulverized toners. Since a releasing agent or a colorant may be easily exposed on a surface of the pulverized toners, anti-cohesiveness and a storage ability of the pulverized toner are relatively poor. In addition, the pulverized toner may contain toner particles having only a releasing agent or toner particles having no releasing agent due to a limit in a mechanical pulverization process. Accordingly, an issue such as inferior image quality like a streak or a gloss decrease may occur.

In fact, an unauthentic polymerized toner has a very large particle size distribution and a great amount of excessively minute toner particles. In addition, since the unauthentic polymerized toner includes a binder resin having an extremely low glass transition temperature just to meet the requirements for the fusing performance, the unauthentic polymerized toner has poor heat storage ability, thus causing problems such as image contamination or toner solidification.

Due to at least such reasons, the unauthentic toner may worsen the durability of components of an electrophotographic printing apparatus and cause deterioration of reproducibility of a dot/line, thus resulting in inferior image quality. Accordingly, an authentic toner needs to be used to prevent such problems. Therefore, there is a demand for a means for discriminating an unauthentic toner from an authentic toner.

As a labelled material for discriminating the unauthentic toner from the authentic toner, use of a fluorescent material or a luminescent material may be taken into account. Generally, the fluorescent material or the luminescent material has been used to improve representation of a color of a toner.

In this case, the fluorescent material or the luminescent material is arranged inside a toner particle. To use the fluorescent material or the luminescent material arranged inside the toner particle as the labelled material, content of the fluorescent material or the luminescent material in the toner particle needs to increase. In addition, according to a degree of compatibility between components of the toner particle (e.g., a binder resin, a releasing agent, a colorant, etc.) with the labeled material, characteristics of the toner (fusing performance, anti-cohesiveness, storage ability, etc.) may be negatively affected. Due to restriction caused according to the compatibility, a range of general-use luminescent materials may be limited.

Provided is an improved toner for electrophotography which effectively show discriminability without any restriction due to compatibility between a labelled material for discriminating an unauthentic toner from an authentic toner and components of a toner particle (e.g., a binder resin, a colorant, a releasing agent, etc.).

According to the present disclosure, a toner for electrophotography includes a toner particle including a binder resin, a colorant, and a releasing agent; and an external additive attached to a surface of the toner particle and including a quantum dot-inorganic particle composite.

<External Additive: A Quantum Dot-Inorganic Particle Composite>

The quantum dot-inorganic particle composite refers to a mixture including i) non-agglomerated quantum dot particles; and ii) inorganic particles other than quantum dots.

According to an example, in the quantum dot-inorganic particle composite, the quantum dot particles may disperse between the inorganic particles or the inorganic particles may disperse between the quantum dot particles. According to the example, cohesion of the quantum dot particles may be suppressed by the inorganic particles present between the quantum dot particles.

According to another example, the quantum dot-inorganic particle composite may be an inorganic particle surface-treated by using a quantum dot. The inorganic particle surface-treated by using a quantum dot refers to such an individual inorganic particle that at least one individual quantum dot is attached to a surface of the individual inorganic particle. According to the example, since individual quantum dots are dispersed and carried on a surface of an inorganic particle, cohesion of the quantum dot particles may be suppressed.

According to another example, the quantum dot-inorganic particle composite may be an inorganic particle having a quantum dot embedded in the inorganic particle. According to the example, since the quantum dot is embedded in the inorganic particle, cohesion between the quantum dot particles may be suppressed.

Since a quantum dot has a very high quantum yield compared to general fluorescent materials, the quantum dot may generate much stronger fluorescence in a much narrower wavelength compared to the general fluorescent materials, and accordingly, may emit light having high color purity.

For example, the quantum dot may emit visible light upon being irradiated by ultraviolet light. For example, a wavelength of light emitted by the quantum dot may be about 400 nm to about 770 nm or about 450 nm to about 750 nm. Accordingly, the quantum dot may function as a labelled material for discriminating an unauthentic toner from an authentic toner in response to the irradiated ultraviolet light.

As the quantum dot is attached to a surface of a toner particle via an inorganic particle used as an external additive, the quantum dot may effectively show discriminability (that is, characteristics of discriminating the unauthentic toner from the authentic toner) without being restricted due to compatibility between components of the toner particle (e.g., a binder resin, a colorant, a releasing agent, etc.) and the quantum dot.

Non-limiting examples of the quantum dot may include CdSe, CdS, CdTe, ZnS, ZnSe, ZnTe, ZnO, HgS, HgSe, HgTe, CdSeS, CdSeTe, CdSTe, ZnSeS, ZnSeTe, ZnSTe, HgSeS, HgSeTe, HgSTe, CdZnS, CdZnSe, CdZnTe, CdHgS, CdHgSe, CdHgTe, HgZnS, HgZnSe, CdHgZnTe, CdZnSeS, CdZnSeTe, CdZnSTe, CdHgSeS, CdHgSeTe, CdHgSTe, HgZnSeS, HgZnSeTe, HgZnSTe; GaN, GaP, GaAs, GaSb, AlN, AlP, AlAs, AlSb, InN, InP, InAs, InSb, GaNP, GaNAs, GaNSb, GaPAs, GaPSb, AlNP, AlNAs, AlNSb, AlPAs, AlPSb, InNP, InNAs, InNSb, InPAs, InPSb, GaAlNP, GaAlNAs, GaAlNSb, GaAlPAs, GaAlPSb, GaInNP, GaInNAs, GaInNSb, GaInPAs, GaInPSb, InAlNP, InAlNAs, InAlNSb, InAlPAs, InAlPSb, SnS, SnSe, SnTe, PbS, PbSe, PbTe, SnSeS, SnSeTe, SnSTe, PbSeS, PbSeTe, PbSTe, SnPbS, SnPbSe, SnPbTe, SnPbSSe, SnPbSeTe, SnPbSTe; Si, Ge, SiC, SiGe or a combination thereof.

The quantum dot may have, for example, a core-shell structure or a core-shell-shell structure. The core of the quantum dot and the shell of the quantum dot may be respectively independently selected from the above-described materials.

According to another example, the quantum dot may be doped with at least one type of transition metal. The transition metal may be selected from, for example, Zn, Mn, Cu, Fe, Ni, Co, Cr, V, Ti, Zr, Nb, Mo, Ru, Rh and a combination thereof.

The quantum dot may have, for example, an average particle size of about 1 nm to about 20 nm. According to an example, the quantum dot may have, for example, an average particle size of about 1 nm to about 15 nm. According to an example, the quantum dot may have, for example, an average particle size of about 5 nm to 10 nm. According to an example, the quantum dot may have, for example, a particle size appropriate for emitting visible light (e.g., a wavelength of about 400 nm to about 770 nm or a wavelength of about 450 nm to about 750 nm).

The quantum dot may be a quantum dot passivated by a polymer to facilitate dispersion.

According to another example, the quantum dot may not contain lead (Pb), mercury (Hg), cadmium (Cd), or chrome (Cr) to fundamentally meet criteria for restriction of hazardous substances (ROHS). However, it is understood that, even when the quantum dot contains Pb, Hg, Cd, or Cr, when content thereof is so small enough to meet the ROHS criteria, the toner in the present disclosure may meet the ROHS criteria.

Non-limiting examples of the inorganic particle surface-treated with the quantum dot may include a silicon oxide particle, a titanium oxide particle, a strontium oxide particle, or a combination thereof. In addition, any inorganic particles used as an external additive for an externally-added toner may be used.

A particle size of an inorganic particle surface-treated by the quantum dot may be, for example, about 1 nm to about 200 nm. According to an example, a particle size of the inorganic particle may be, for example, about 7 nm to about 200 nm. According to an example, a particle size of the inorganic particle may be, for example, about 10 nm to about 200 nm.

The quantum dot-inorganic particle composite may be prepared, for example, by mixing aninorganic particle dispersion with a quantum dot dispersion, removing a dispersion medium from the mixture, and attaching the quantum dot to a surface of the inorganic particle.

According to an example, the quantum dot-inorganic particle composite may be prepared, for example, by mixing an inorganic particle dispersion with a quantum dot dispersion, removing a dispersion medium from the mixture, and dispersing the quantum dot between the inorganic particles.

According to an example, the quantum dot-inorganic particle composite may be prepared, for example, by adding the quantum dot (or the quantum dot dispersion) to a reaction mixture for preparing inorganic particles to form an inorganic particle in which the quantum dots are embedded. For example, sol-gel silica particles in which the quantum dots are embedded may be obtained by hydrolytically condensing an alkoxy silane in a reaction medium including the quantum dot, water, and an organic solvent.

In the quantum dot-inorganic particle composite, a weight ratio of the quantum dot to the inorganic particle may be, for example, about 0.05:100 to 1.0:100.

The quantum-inorganic particle composite may be, for example, attached to a surface of the toner particle by using a method of preparing an externally-added toner.

An amount of the quantum-inorganic particle composite may be, for example, about 0.5 part by weight to about 2 parts by weight with reference to 100 parts by weight of the toner particle.

<Toner Particle>

The toner particle may include a binder resin, a colorant, and a releasing agent.

Non-limiting examples of the binder resin may include a styrenic resin, an acrylic resin, a vinyl resin, a polyether polyol resin, a phenolic resin, a silicone resin, a polyester resin, an epoxy resin, a polyamide resin, a polyurethane resin, polybutadiene resin, or a mixture thereof.

Non-limiting examples of the styrenic resin may include polystyrene; a homopolymer of styrene with a substituent, such as poly-p-chlorostyrene or polyvinyltoluene; a styrene-based copolymer, such as a styrene-p-chlorostyrene copolymer, a styrene-vinyltoluene copolymer, a styrene-vinylnaphthalene copolymer, a styrene-acrylic acid ester copolymer, a styrene-methacrylic acid ester copolymer, a styrene-methyl α-chloromethacrylate copolymer, a styrene-acrylonitrile copolymer, a styrene-methyl vinyl ether copolymer, a styrene-vinyl ethyl ether copolymer, a styrene-vinyl methyl ketone copolymer, a styrene-butadiene copolymer, styrene-isoprene copolymer or a styrene-acrylonitrile-indene copolymer; or a mixture thereof.

Non-limiting examples of the acrylic resin may include an acrylic acid polymer, a methacrylic acid polymer, a methacrylic acid methyl ester copolymer, an α-chloro methacrylic acid methyl ester copolymer, or a mixture thereof.

Non-limiting examples of the vinyl resin may include a vinyl chloride polymer, an ethylene polymer, a propylene polymer, an acrylonitrile polymer, a vinyl acetate polymer, or a mixture thereof.

Non-limiting examples of a number-average molecular weight of the binder resin may be in a range of about 700 to about 1,000,000, or about 10,000 to about 200,000.

Non-limiting examples of the colorant may include a black colorant, a yellow colorant, a magenta colorant, a cyan colorant, or a combination thereof.

Non-limiting examples of the black colorant may include carbon block, aniline black, or a mixture thereof.

Non-limiting examples of the yellow colorant may include a condensed nitrogen compound, an isoindolinone compound, an anthraquine compound, an azo metal complex, an allyl imide complex, or a mixture thereof. More particular non-limiting examples of the yellow colorant may be "CI (color index) Pigment Yellow" 12, 13, 14, 17, 62, 74, 83, 93, 94, 95, 109, 110, 111, 128, 129, 147, 168, or 180.

Non-limiting examples of the magenta colorant may include a condensed nitrogen compound, an anthraquine compound, a quinacridone compound, a base dye lake, a naphtol compound, a benzoimidazole compound, a thioindigo compound, a perylene compound, or a mixture thereof. More particular non-limiting examples of the magenta colorant may be "C.I. Pigment Red" 2, 3, 5, 6, 7, 23, 48:2, 48:3, 48:4, 57:1, 81:1, 122, 144, 146, 166, 169, 177, 184, 185, 202, 206, 220, 221, or 254.

Non-limiting examples of the cyan colorant may include a copper phthalocyanine compound or a derivative thereof, an anthraquine compound, a base dye lake, or a mixture thereof. More particular non-limiting examples of the cyan colorant may be "C.I. Pigment Blue" 1, 7, 15, 15:1, 15:2, 15:3, 15:4, 60, 62, or 66.

Non-limiting examples of a content of the colorants in the toner particle may be in a range of about 0.1 parts by weight to about 20 parts by weight or a range of about 2 parts by weight to about 10 parts by weight with reference to 100 parts by weight of the binder resin.

Non-limiting examples of the releasing agent may include a polyethylene-based wax, a polypropylene-based wax, a silicone-based wax, a paraffin-based wax, an ester-based wax, a carnauba wax, a metallocene-based wax, or a mixture thereof.

The releasing agent may have, as a non-limiting example, a melting point in a range of about 50° C. to about 150° C.

Non-limiting examples of a content of the releasing agent in the toner particle may be in a range of about 1 part by weight to about 20 parts by weight or a range of about 1 part by weight to about 10 parts by weight with reference to 100 parts by weight of the binder resin.

The toner particle may further include a shell layer. The shell layer surrounds a core particle. The shell layer includes a binder resin for the shell layer. The binder resin for a shell layer may be, as a non-limiting example, a styrenic resin, an acrylic resin, a vinyl resin, a polyether polyol resin, a phenolic resin, a silicone resin, a polyester resin, an epoxy resin, a polyamide resin, a polyurethane resin, polybutadiene resin, or a mixture thereof. Non-limiting examples of the styrenic resin may include polystyrene; a homopolymer of styrene with a substituent, such as poly-p-chlorostyrene or polyvinyltoluene; a styrene-based copolymer, such as a styrene-p-chlorostyrene copolymer, a styrene-vinyltoluene copolymer, a styrene-vinylnaphthalene copolymer, a styrene-acrylic acid ester copolymer, a styrene-methacrylic acid ester copolymer, a styrene-methyl α-chloromethacrylate copolymer, a styrene-acrylonitrile copolymer, a styrene-methyl vinyl ether copolymer, a styrene-vinyl ethyl ether copolymer, a styrene-vinyl methyl ketone copolymer, a styrene-butadiene copolymer, styrene-isoprene copolymer or a styrene-acrylonitrile-indene copolymer; or a mixture thereof. Non-limiting examples of the acrylic resin may include an acrylic acid polymer, a methacrylic acid polymer, a methacrylic acid methyl ester copolymer, an α-chloro methacrylic acid methyl ester copolymer, or a mixture thereof. Non-limiting examples of the vinyl resin may include a vinyl chloride polymer, an ethylene polymer, a propylene polymer, an acrylonitrile polymer, a vinyl acetate polymer, or a mixture thereof. Non-limiting examples of a number-average molecular weight of the binder resin for a shell layer may be in a range of about 700 to about 1,000,000, or about 10,000 to about 200,000. The binder resin for a shell layer may be identical to or different from the binder resin for the core particle.

<Additional External Additive>

According to another example of the toner in the present disclosure, the external additive may further include, in addition to the quantum dot-inorganic composite, an inorganic particle other than the quantum dot-inorganic particle composite. Non-limiting examples of the additional inorganic particle may include a silica particle and a titanium-containing particle.

The silica particle may be, for example, fumed silica, sol-gel silica or a mixture thereof.

When the primary particle size of the silica particles is too large, toner particles externally added therewith may be relatively difficult to pass through a developing blade. Accordingly, a selection phenomenon of toner may occur. That is, as a period of a toner cartridge having been used increases, a particle size of the toner particles remaining in the toner cartridge gradually increases. As a result, a quantity of charge of toner decreases and thus the thickness of a toner layer developing an electrostatic latent image increases. In addition, when the primary particle size of the silica particles is too large, a probability of the silica particles to be separated from the core particles may relatively increase due to stress applied to the toner particles from a member such as a feed roller. The separated silica particles may contaminate a charging member or a latent image carrier. On the other hand, when the primary particle size of the silica particles is too small, the silica particles are likely to be buried into the core particles due to shearing stress of a developing blade that is applied to the toner particles. If the silica particles are buried into the core particles, the silica particles lose a function as an external additive. Accordingly, adhesion between the toner particles and the surface of a photoconductor may be undesirably increased. This may lead to reduction in cleaning ability and transferability of the toner. For example, a volume average primary particle size of the silica particles may be in a range of about 10 nm to about 80 nm, in particular in a range of about 30 nm to 80 nm, or in a range of about 60 nm to about 80 nm.

According to another example of the toner in the present disclosure, the silica particles may include large silica particles having a volume average particle size of about 30 nm to about 100 nm and small silica particles having a volume average particle size of about 5 nm to about 20 nm. The small silica particles may enhance charging stability of the toner particle by providing a larger surface area compared to that of the large silica particles. In addition, the small silica particles are attached to the core particle such that the small silica particles are arranged between the large silica particles. Thus, even when a shearing stress is exerted on the toner particle from outside, the shearing stress is not transmitted to the small silica particle. That is, the shearing stress exerted on the toner particle from the outside is concentrated on the large silica particle. Accordingly, the small silica particle may not be buried in the core particle and maintain an effect in which the charging stability of the toner particle improves. When content of the small silica particles is too small compared to that of the large silica particles, durability of the toner may deteriorate and the effect in which the charging stability of the toner particle improves may be small. When content of the small silica particles is too large, the charging member or the latent image carrier may be contaminated due to poor cleaning. A weight ratio of the large silica particle to the small silica particle may be, for example, about 0.5:1.5 to about 1.5:0.5.

According to another example of the toner in the present disclosure, the silica particles may include sol-gel silica having a number-average aspect ratio of about 0.83 to about 0.97. Here, the aspect ratio refers to a ratio of a shortest diameter to a greatest diameter of the sol-gel silica particle. In the present disclosure, the number-average aspect ratio of the sol-gel silica particles is defined as a value calculated by obtaining a 50,000 time magnified plane image by analyzing toner particles externally added with the sol-gel particles by using scanning electron microscopy (SEM), obtaining an aspect ratio of each sol-gel silica particle by analyzing the shortest diameter and the greatest diameter of each sol-gel silica particle on the 50,000 time magnified plane image by using an image analyzer, and then, dividing a sum of the aspect ratios of the sol-gel silica particles by a number of the sol-gel silica particles. In this case, the number of the sol-gel silica particles included in calculation of the number-average aspect ratio is fixed as 50. According to the present disclosure, when sol-gel silica particles having a number-average aspect ratio of about 0.83 to about 0.97 is used as an external additive, it is shown that a cleaning ability of the toner greatly increases. Enhancement of the cleaning ability of the toner indicates that an adhesive power of the toner particle to the surface of the photoreceptor is properly decreased. When the cleaning ability of the toner improves, in an electrophotography process, when there remain a toner untransferred from the photoreceptor after the transferring process, the untransferred toner may be almost completely removed by the cleaning blade. Accordingly, contamination of the charging roller that may be caused by the untransferred toner may be suppressed. A filming phenomenon on the surface of the photoreceptor that may be caused by the untransferred toner may be suppressed. In addition, since an untransferred external additive on the photoreceptor is nano-sized, the untransferred external additive may easily pass through a gap between the blade and the photoreceptor. Particularly, the external additive having a round shape may easily rotate, and thus, may easily pass through the blade. After the external additive has passed through the blade, the external additive may contaminate the charging roller. Accordingly, when an aspect ratio of the silica is reduced to prevent the external additive from easily passing through the blade, the cleaning ability of the external additive may improve.

For example, the sol-gel silica particle may be obtained by hydrolytically condensing an alkoxy-silane in an organic solvent where water is present to produce a silica sol suspension and removing the solvent from the silica sol suspension.

A representative example of a titanium-containing particle is titanium dioxide, but is not limited thereto. Anatase-type titanium dioxide having an anatase crystal structure or rutile-type titanium dioxide having a rutile crystal structure may be used as a titanium dioxide particle. Titanium dioxide may be used as the external additive to the toner. This is because, when only silica having strong negative chargeability is externally added to the surface of the toner, charge-up may easily occur and, particularly in a contact developing system, an amount of the toner attached to the developing roller becomes great, and thus, a toner layer thereon may become thicker. In a non-contact developing system, when titanium oxide is not used, since an amount of electric charges of the toner becomes great, developing property may deteriorate, thus resulting in low image density. Accordingly, to stabilize a sudden fluctuation in charging when only silica is externally added to the toner, titanium oxide may be added to the toner, thus reducing a charging deviation in an environment such as a high temperature and high humidity condition or a low temperature and low humidity condition, and improving charge-up. However, when titanium oxide is overused, background contamination may occur. Thus, an appropriate ratio of silica having strong negative chargeability and titanium oxide having low negative chargeability may affect an electrophotography system with respect to durability and other image contamination as well as a quantity of charge.

Silica particles and titanium dioxide particles may be, for example, hydrophobically treated with a silicone oil, a silane, a siloxane, or a silazane. A degree of hydrophobicity of each of silica particles and titanium dioxide particles may be in a range of about 10 to about 90. The degree of hydrophobicity refers to a value measured by using a methanol titration method known in the art to which the present disclosure belongs. For example, the degree of hydrophobicity may be measured as follows. To a glass beaker with an internal diameter of 7 cm, a volume of 2 L or more, and containing 100 ml of ion exchange water is added 0.2 g of silica particles or titanium dioxide particles for measuring the degree of hydrophobicity, and the resulting solution is stirred with a magnetic stirrer. A tip part of a burette containing methanol is immersed in the suspension, into which 20 ml of methanol is dripped with stirring, the stirring is stopped after 30 seconds, and 1 minute after stopping the stirring the state of the suspension is observed. This operation is repeatedly performed. When silica particles or titanium dioxide particles do not float on the water surface 1 minute after stopping the stirring, the total added amount of methanol is taken as Y (unit: ml) and a value obtained by the following formula is calculated as the degree of hydrophobicity. The water temperature in the beaker is adjusted to about 20° C.±1° C. to perform the measurement. Degree of hydrophobicity=[Y/(100+Y)]×100].

In the toner of the present disclosure, a core particle and a shell layer may be prepared by using a coagulation method using a coagulant. A representative example of the coagulant may be, for example, poly silicate iron.

EXAMPLES

Synthesis Example 1—Synthesis of Indium Phosphide (InP) Quantum Dots

A first reactant is obtained by adding indium acetate (0.2 mmol) to a mixture of palmitic acid (0.7 mmol) and octadecene (10 mL). The first reactant is heated to 120° C. in a vacuum state, and then, maintained at 120° C. for 1 hour. A second reactant is obtained by mixing 0.1 mmol of trimethylsilyl-3-phosphine with 1 mL of trioctylphosphine. The first reactant is heated to 280° C. under an atmosphere of nitrogen, and then, the second reactant is put into the first reactant. The first reactant is reacted with the second reactant for 2 minutes. Then, after a reactant mixture of the first and second reactants is quickly cooled to room temperature, acetone is added to the reactant mixture to obtain an InP quantum dot dispersion (Average particle size of the quantum dot: 7 nm; containing 0.75 g of InP quantum dot with reference to 100 g of dispersion).

Preparing Example 1—An Inorganic Particle Surface-Treated with Quantum Dots 5 g of silica particles (supplier: Nippon Aerosol, average particle size: 40 nm) and 50 g of isopropyl alcohol (IPA) are put into a 1 L reactor, and then, stirred at 150 rpm for 30 minutes by using an anchor-type impeller, thus obtaining a dispersion of silica particles dispersed in IPA. While the dispersion of silica particles in the 1 L reactor is stirred, 10 g of InP quantum dot dispersion (synthesis example 1) is gradually added to the dispersion. Then, the resulting mixture is stirred at 45° C. at 500 rpm for 2.5 hours to evaporate a portion of the solvent (i.e., IPA). In the solvent evaporation process, silica particles are surface-treated with InP quantum dots. The thus-obtained silica particles surface-treated with InP quantum dots is referred to as QEA-1.

Preparing Examples 2 to 5—An Inorganic Particle Surface-Treated with Quantum Dots Inorganic particles QEA-2 to QEA-5 surface-treated with quantum dots are prepared by using the same method as that of preparing example 1 but using different types of inorganic particles and quantum dot dispersions. Process conditions of preparing examples 1 to 5 are summarized in Table 1 shown below.

TABLE 1

| | Inorganic Particle | | Quantum Dot Dispersion | | |
|---|---|---|---|---|---|
| Preparing Example No. | Component | Average Particle Size (nm) | Quantum Dot Component | Average Particle Size of Quantum Dot (nm) | Concentration of Dispersion (Quantum Dot-g/Dispersion-100) |
| Preparing Example 1 | $SiO_2$ | 40 | InP | 7 | 0.75 |
| Preparing Example 2 | $SiO_2$ | 150 | InP | 7 | 0.75 |
| Preparing Example 3 | $TiO_2$ | 40 | InP | 7 | 0.75 |
| Preparing Example 4 | $SiO_2$ | 220 | InP | 7 | 0.75 |
| Preparing Example 5 | $SiO_2$ | 40 | CdSe | 7 | 0.75 |

Preparing Example 6—Quantum Dot Powders

The InP quantum dot dispersion obtained from Synthesis example 1 is dried at room temperature (25° C., 1 atm) to obtain a solid. The solid is ground by using a mortar and pestle to obtain InP quantum dot powders (QEA-6).

Preparing Example 7—Binder Resin Latex 500 g of a polyester resin, 450 g of methyl ethyl ketone (MEK), and 150 g of IPA are put into a 3 L reactor, and then, are stirred at 30° C. by using an semi-moon type impeller, thus obtaining a polyester resin solution. While the polyester resin solution is stirred, an aqueous ammonia solution of 5 wt % is gradually added to the polyester resin solution to adjust a pH of the polyester resin solution to pH 7.5. Then, while the polyester resin solution is stirred, 2,000 g of water are added thereto at a speed of 20 g/min, thus obtaining an emulsion. A solvent is removed from the emulsion by distilling the emulsion under reduced pressure, thereby obtaining a binder resin latex having a solids concentration of 20 wt %.

Preparing Example 8—Colorant Dispersion 10 g of an anionic reactive emulsifier (supplier: DAI-ICH KOGYO Co. (Japan), product name: HS-10) and 60 g of a cyan colorant (Pigment Blue 15:4) are milled at a room temperature in a milling bath (containing 400 g of glass bead having a diameter of about 0.8 to about 1 mm), thereby preparing a colorant dispersion.

Wax Dispersion

SELOSOL P-212 (paraffin wax 80 to 90% and synthetic ester wax 10 to 20%; Tm: about 72° C.; viscosity: 13 mPa·s at 25° C.) provided by CHUKYO YUSHI Co., Ltd., Japan is used as the wax dispersion.

Example 1—Toner Preparation 764 g of deionized water and 812 g of latex for a core (Preparing example 7) are put into a 3 L reactor and stirred at 350 rpm. Then, 77 g of a colorant dispersion (Preparing example 8), 80 g of wax dispersion P-212, and a coagulant formulation (containing 50 g of an aqueous solution of 0.3 M nitric acid and 25 g of PSI-100 (SUIDO KIKO KAISHA LTD.)) are additionally put into the 3 L reactor. Then, the mixture in the reactor is stirred by using a homogenizer and heated to 50° C. at a rate of 1° C./minute. Then, while the mixture is stirred, the mixture is heated to at a rate of 0.03° C./minute. Then, when the core particles in the mixture coagulate to have a size of 5 μm, 300 g of a latex for forming a shell layer (Preparing example 7) is added to the mixture and the mixture is stirred for an hour, thereby producing core-shell particles. Then, a 1 N NaOH aqueous solution is added to the mixture to adjust a pH of the mixture to 8.5 and the mixture is stirred for 20 minutes. Then, the mixture is heated to 90° C., and then, stirred for 5 hours to coagulate the core-shell particles to have a size of 7 Then, the mixture is cooled to a temperature of less than 35° C. Then, the core-shell particles are separated from the mixture and dried.

Then, 100 parts by weight of the core-shell particles, 0.6 part by weight of QEA-1 (inorganic particles surface-treated with quantum dots and obtained from Preparing example 1), 1 part by weight of a general external additive ((0.5 part by weight of RY-50 (supplier: Nippon Aerosil, Japan) and 0.5 part by weight of SW-350 (supplier: Titan Kogyo, Japan)) are put into a mixer (KM-LS2K, DAEHWA TECH IND.), and then, stirred at 2,000 rpm for 30 seconds, then, at 6,000 rpm for 3 minutes. Accordingly, the inorganic particles surface-treated with quantum dots are attached to a surface of the core-shell particles, thereby producing externally added toner of Example 1.

Examples 2~5 and Comparative Examples 1~4

Externally added toners of Examples 2 to 5 and Comparative examples 1 to 4 are prepared by using the same method as that of Example 1, except for using different types of inorganic particles surface-treated with quantum dots. Compositions of the externally added toners of Examples 1 to 5 and Comparative examples 1 to 4 are summarized in Table 2 shown below. In Comparative example 4, quantum dot powders (i.e., InZnP powders obtained from Preparing example 6) (QEA-6) are used instead of the inorganic particles surface-treated with quantum dots.

TABLE 2

| Example No. | Composition of External Additive (with reference to 100 parts of the core-shell particle) | | | | |
|---|---|---|---|---|---|
| | Inorganic Particles Surface-treated with Quantum Dots | | | RY-50 | SW-350 |
| | Name | Material | Parts by weight | (Parts by weight) | (Parts by weight) |
| Example 1 | QEA-1 | InZnP-coated $SiO_2$ | 0.6 | 0.5 | 0.5 |
| Example 2 | QEA-2 | InZnP-coated $SiO_2$ | 1.0 | 0.5 | 0.5 |
| Example 3 | QEA-1 | InZnP-coated $SiO_2$ | 2.0 | 0.5 | 0.5 |
| Example 4 | QEA-3 | InZnP-coated $TiO_2$ | 0.9 | 0.5 | 0.5 |
| Example 5 | QEA-5 | CdSe-coated $SiO_2$ | 1.2 | 0.5 | 0.5 |
| Comparative Example 1 | QEA-1 | InZnP-coated $SiO_2$ | 0.4 | 0.5 | 0.5 |
| Comparative Example 2 | QEA-1 | InZnP-coated $SiO_2$ | 2.4 | 0.5 | 0.5 |
| Comparative Example 3 | QEA-4 | InZnP-coated $SiO_2$ | 1.3 | 0.5 | 0.5 |
| Comparative Example 4 | QEA-6 | InZnP powder | 1.8 | 0.5 | 0.5 |

<Toner Evaluation Method>

Evaluation of Fusing Performance

Equipment: Samsung Electronics Color Laser Printer C2620 (equipped with IFS2 Fuser)

Fixed image for a test: S600 solid pattern

Test temperature: 165° C.

Fixing speed: 180 mm/sec

Fusing performance of an image fixed under the conditions as above is evaluated as follows. Optical density (OD) of a fixed image is measured. Then, a 3M 810 tape is adhered to the fixed image. A 500 g weight is moved back and forth on the 3M 810 tape for 5 times, and then, the tape is peeled. The OD of the fixed image is measured after the tape has been peeled.

Fusing performance (%)=(OD after the tape is peeled/OD before the tape is peeled)×100

A fixing temperature area in which the fusing performance is 90% or greater is regarded as a fixing area of a toner.

Evaluation Criteria

○: Fine image (Fusing performance of 90% or greater)

Δ: Poor image (Fusing performance of less than 90%)

X: Occurrence of cold offset

Analysis of a Particle Size of an Inorganic Particle

A particle size of an inorganic particle is measured by using a field emission scanning microscope (FE-SEM) (manufacturer: HITACHI, product name: S-4500, measurement conditions: a vacuum pressure of $10^{-4}$ Pa or greater, an accelerated voltage of 5-15 kV).

Fluorescent X-Ray Measurement

Fluorescent X-ray Measurement is performed by using an energy dispersive X-ray spectrometer (model no.: EDX-720) manufactured by SHIMADZU Corporation. An X-ray tube voltage is 50 kV and sample forming volume is 3 g±0.01 g.

Evaluation of Discriminability of Toner

Equipment: VILBER LOURMAT UV Lamps VL-6. LC

Sample volume: 2 g (externally added toner)

Wavelength: 254 nm, 365 nm

By using the equipment described above, after ultraviolet light is irradiated to the externally added toner, the discriminability of the toner (that is, an ability of emitting visible light for indicating an authentic toner) is evaluated as follows.

Criteria for Evaluation of the Discriminability

◎: State in which discrimination is fine (visible light may be clearly detected by naked eye)

○: State in which discrimination is possible (visible light may be detected by naked eye)

Δ: State in which discrimination is difficult (visible light may be hardly detected by naked eye)

X: State in which discrimination is impossible (visible light may not be detected by naked eye)

<Evaluation Results>

Results of the evaluation of the externally added toners prepared in Examples 1 to 5 and Comparative examples 1 to 4 are shown in Table 3 shown below.

TABLE 3

| Externally Added Toner Sample | Labelled External Additive Name | Labelled External Additive Material | Labelled External Additive Quantity (Parts by weight) | Whether Heavy Metal(s) is included | Fusing Performance | Discriminability |
|---|---|---|---|---|---|---|
| Example 1 | QEA-1 | InZnP-coated $SiO_2$ | 0.6 | X | ○ | ○ |
| Example 2 | QEA-2 | InZnP-coated $SiO_2$ | 1.0 | X | ○ | ◎ |
| Example 3 | QEA-1 | InZnP-coated $SiO_2$ | 2.0 | X | ○ | ◎ |
| Example 4 | QEA-3 | InZnP-coated $TiO_2$ | 0.9 | X | ○ | ○ |
| Example 5 | QEA-5 | CdSe-coated $SiO_2$ | 1.2 | ○ | ○ | ◎ |
| Comparative example 1 | QEA-1 | InZnP-coated $SiO_2$ | 0.4 | X | ○ | X |
| Comparative example 2 | QEA-1 | InZnP-coated $SiO_2$ | 2.4 | X | X | ◎ |
| Comparative example 3 | QEA-4 | InZnP-coated $SiO_2$ | 1.3 | X | ○ | Δ |
| Comparative example 4 | QEA-6 | InZnP Powder | 1.8 | X | Δ | X |

As shown in Table 3, the externally added toners of Examples 1 to 4, wherein inorganic particles surface-treated with heavy metal-free quantum dots are externally added to the surface of the toner particles, show clear discriminability based on fluorescent characteristics obtained upon irradiation of ultraviolet light without deterioration of fusing performance, while the discriminability may not be obtained from toners containing a general external additive (that is, an inorganic particle without surface-treatment with a quantum dot).

In the case of Example 5 in which a quantum dot (cadmium selenide (CdSe)) contains cadmium (Cd) that is a heavy metal, fusing performance and discriminability are excellent. However, since the externally added toner prepared in Example 5 contains a heavy metal, the toner is not environment-friendly and may be harmful to human body. Accordingly, the externally added toner of Example 5 may have a limited scope of application.

In the case of the externally added toner prepared in Comparative example 1, since the used amount of the inorganic particles surface-treated with quantum dots is very small, the discriminability of the toner is poor. In the case of the externally added toner of Comparative example 2, since the used amount of the inorganic particles surface-treated with quantum dots is excessive, the discriminability of the toner is excellent but the fusing performance thereof is very poor.

In the case of Comparative example 3, since a particle size of the inorganic particles surface-treated with quantum dots is very large, discriminability of the toner is poor. When the particle size of the inorganic particles surface-treated with quantum dots is large, compared to an amount of an increase in adhesive force between the inorganic particles and the toner particles, an amount of an increase in mass of the inorganic particles and an increase in detachment force between the inorganic particles and the toner particles becomes greater. Accordingly, when the particle size of the inorganic particles surface-treated with quantum dots is too large (e.g., larger than about 200 nm), the inorganic particles surface-treated with quantum dots may easily drop off from a surface of the toner particles. Therefore, since an amount of the inorganic particles remaining on the surface of the toner particles becomes small compared to an input amount of the inorganic particles surface-treated with quantum dots, sufficient discriminability may not be obtained.

In Comparative example 4, quantum dot powders instead of the inorganic particles surface-treated with quantum dots are attached to a surface of the toner particles as an external additive. However, when ultraviolet light is irradiated, the externally added toner of Comparative example 4 is not distinguished from a general toner not containing quantum dots. This is because, since cohesion between the quantum dots occurs in a process of drying a quantum dot dispersion to generate quantum dot powders, the quantum dots form an agglomerate, thus greatly worsening quantum efficiency of the quantum dots (e.g., about 75%→ about 15%). Moreover, since the agglomerate of the quantum dots has a large particle size, adherence of the agglomerate of the quantum dots to the surface of the toner particles significantly deteriorates compared to that of respective quantum dots not agglomerated. Accordingly, when the quantum dots form an agglomerate having a large particle size, adherence of the agglomerate of the quantum dots to the surface of toner particles deteriorates, and thus, an amount of quantum dots actually remaining on the surface of toner particles may greatly decease, thus worsening the final discriminability of the toner.

What is claimed is:

1. A toner for electrophotography, the toner comprising:
a toner particle including a binder resin, a colorant, and a releasing agent; and
an additive material including a quantum dot-inorganic particle composite, wherein
the additive material is attached to an external surface of the toner particle,
the quantum dot-inorganic particle composite includes quantum dot particles and inorganic particles present between the quantum dot particles, the quantum dot particles being more compatibly attachable to the inorganic particles than to the external surface of the toner particle, and
the quantum dot particles are to emit first light having a first wavelength when being irradiated with second light having a second wavelength different from the first wavelength.

2. The toner of claim 1, wherein
in the quantum dot-inorganic particle composite, the quantum dot particles are dispersed among the inorganic particles or the inorganic particles are dispersed among the quantum dot particles.

3. The toner of claim 1, wherein the inorganic particles are surface treated with the quantum dot particles, to be between the quantum dot particles.

4. The toner of claim 1, wherein the quantum dot particles are embedded in the inorganic particles between the quantum dot particles.

5. The toner of claim 1, wherein a content of the quantum dot-inorganic particle composite is about 0.5 to about 2 parts by weight with reference to 100 parts by weight of the toner particle.

6. The toner of claim 1, wherein an average particle size of the inorganic particles in the quantum dot-inorganic particle composite is equal to or less than about 200 nm.

7. The toner of claim 1, wherein a wavelength of light to be emitted by the quantum dot particles is in a first wavelength range of about 400 nm to about 770 nm or in a second wavelength range including wavelengths corresponding to infrared light (IR), near-infrared light (NIR), or visible light.

8. The toner of claim 1, wherein the quantum dot particles are doped with at least one type of transition metals.

9. The toner of claim 1, wherein the quantum dot particles are to emit visible light, or infrared light (IR), or near infrared light (NIR), by irradiation of light.

10. A toner cartridge for electrophotography, comprising:
a toner including:
a toner particle including a binder resin, a colorant, and a releasing agent; and
an additive material comprising a quantum dot-inorganic particle composite, wherein
the additive material is attached to an external surface of the toner particle,
the quantum dot-inorganic particle composite includes quantum dot particles and inorganic particles present between the quantum dot particles, the quantum dot particles being more compatibly attachable to the inorganic particles than to the external surface of the toner particle, and
the quantum dot particles are to emit first light having a first wavelength when being irradiated with second light having a second wavelength different from the first wavelength.

11. The toner cartridge of claim 10, wherein
in the quantum dot-inorganic particle composite, the quantum dot particles are dispersed among the inorganic particles or the inorganic particles are dispersed among the quantum dot particles.

12. The toner cartridge of claim 10, wherein the quantum dot-inorganic particle composite is the inorganic particles having a surface treated with the quantum dot particles, to be between the quantum dot particles.

13. The toner cartridge of claim 10, wherein the quantum dot-inorganic particle composite has the quantum dot particles embedded in the inorganic particles between the quantum dot particles.

14. The toner cartridge of claim 10, wherein a content of the quantum dot-inorganic particle composite is about 0.5 to about 2 parts by weight with reference to 100 parts by weight of the toner particle.

15. The toner cartridge of claim 10, wherein an average particle size of the inorganic particles in the quantum dot-inorganic particle composite is equal to or less than about 200 nm.

16. The toner cartridge of claim 10, wherein a wavelength of light to be emitted by the quantum dot particles is in a first wavelength range of about 400 nm to about 770 nm or in a second wavelength range including wavelengths corresponding to infrared light (IR), near-infrared light (NIR) or visible light.

17. The toner cartridge of claim 10, wherein the quantum dot particles are doped with at least one type of transition metals.

18. The toner cartridge of claim 10, wherein the quantum dot particles are to emit visible light, or infrared light (IR), or near infrared light (NIR), by irradiation of light.

* * * * *